US007957673B2

(12) United States Patent
Geyling et al.

(10) Patent No.: US 7,957,673 B2
(45) Date of Patent: Jun. 7, 2011

(54) TONER TRANSFER SYSTEMS WITH AN ADJUSTABLE TRANSFER BELT FOR USE IN AN IMAGE FORMING DEVICE

(75) Inventors: Alexander J. Geyling, Lexington, KY (US); John D. Butler, Lexington, KY (US); James Philip Harden, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 741 days.

(21) Appl. No.: 11/947,277

(22) Filed: Nov. 29, 2007

(65) Prior Publication Data

US 2009/0142097 A1 Jun. 4, 2009

(51) Int. Cl.
*G03G 15/08* (2006.01)
*G03G 15/00* (2006.01)

(52) U.S. Cl. ..... 399/121; 399/165

(58) Field of Classification Search ..... 399/121, 399/165, 302, 308
See application file for complete search history.

(56) References Cited

U.S. PATENT DOCUMENTS 7,133,631 B2 * 11/2006 Ito et al. ..... 399/302
* cited by examiner

*Primary Examiner* — David M Gray
*Assistant Examiner* — Gregory H Curran

(57) ABSTRACT

The present application is directed to toner transfer systems with an adjustable transfer belt. The transfer belt transfers toner images from a first location to a second location. Two or more support rolls position and drive the transfer belt. A tensioning device is operatively connected to one of the support rolls. The tensioning device moves the support roll between a first position that places a first amount of tension on the belt, and a second position that places a lesser second amount of tension on the belt. The support roll is in the first position during image formation, and in the second position during non-image formation such as storage and shipping.

20 Claims, 5 Drawing Sheets

TONER TRANSFER SYSTEMS WITH AN ADJUSTABLE TRANSFER BELT FOR USE IN AN IMAGE FORMING DEVICE

BACKGROUND

The present application is directed to toner transfer systems for an image forming device and, more specifically, toner transfer systems with a tension device to adjust tension on a transfer belt.

Image forming devices such as but not limited to printers, facsimile machines, copiers, and multi-functional devices, may include an image transfer belt. The belt functions to receive an image at a first location within the image forming device and transport the image to a second location. One embodiment includes a belt for use in an electrophotographic image formation process. The belt receives a toner image from one or more photoconductive members and transfers the toner image or images to a media sheet.

The belt may extend around a number of rolls, including a drive roll and a tension roll. The tension roll keeps the belt tight to provide drive capability at the drive roll. The tension may damage the belt, particularly when the tension is applied for extended periods of time and when the belt is in a hot environment. One environment that may damage the belt is a school that has been closed for the summer. The belt may take the form of the rolls it wraps around, which is referred to as belt set. Belt set may cause motion quality defects during image formation. Removing the tension from the belt may be beneficial to extend the life of the belt by preventing belt set.

Reducing an overall cost is also an important consideration when designing an image forming device. Cost is often a driving factor for consumers when making a purchasing decision. One manner of reducing the cost is to use parts for multiple functions. This eliminates additional parts thereby reducing the overall cost. Further, the reduction in parts may also provide improved maintenance because of fewer parts that may fail or otherwise become problematic.

SUMMARY

The present application is directed to toner transfer systems in an image forming device. The systems may include a plurality of rolls comprising at least a drive roll and a tension roll. A transfer belt may extend around the plurality of rolls. At least one imaging station may be positioned in proximity to the transfer belt to form a toner image on the transfer belt. An arm with first and second ends may be positioned in proximity to the transfer belt. The arm may be pivotally movable between a first orientation that causes the tension roll to be at a first position. This first position may cause a first amount of tension on the transfer belt that may allow the toner image to be formed on the transfer belt and moved to a second transfer point. The arm may be movable to a second orientation that may be in contact with the tension roll that causes the tension roll to be at a second position. The second position may cause a second lesser amount of tension on the transfer belt.

DETAILED DESCRIPTION

Figure 1:
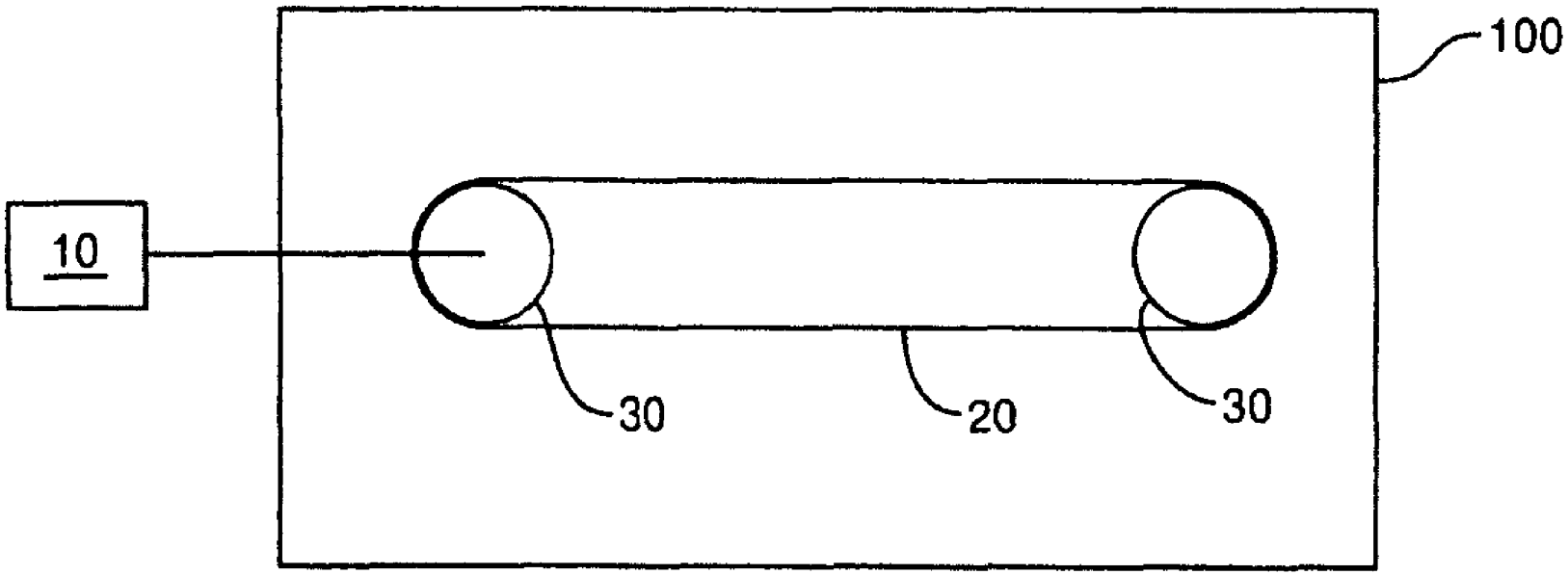
FIG. 1 is a schematic side view of an image forming device with a tensioning device according to one embodiment.

The present application is directed to toner transfer systems with an adjustable transfer belt. FIG. 1 illustrates a schematic representation of an image forming device 100. A transfer belt 20 is positioned within the image forming device 100 for transferring toner images from a first location to a second location. Two or more support rolls 30 position and drive the transfer belt 20. A tensioning device 10 is operatively connected to one of the support rolls 30. The tensioning device 10 moves the support roll 30 between a first position that places a first amount of tension on the belt 20, and a second position that places a lesser second amount of tension on the belt 20. The support roll 30 is in the first position during image formation, and in the second position during non-image formation such as storage and shipping.

Figure 2:
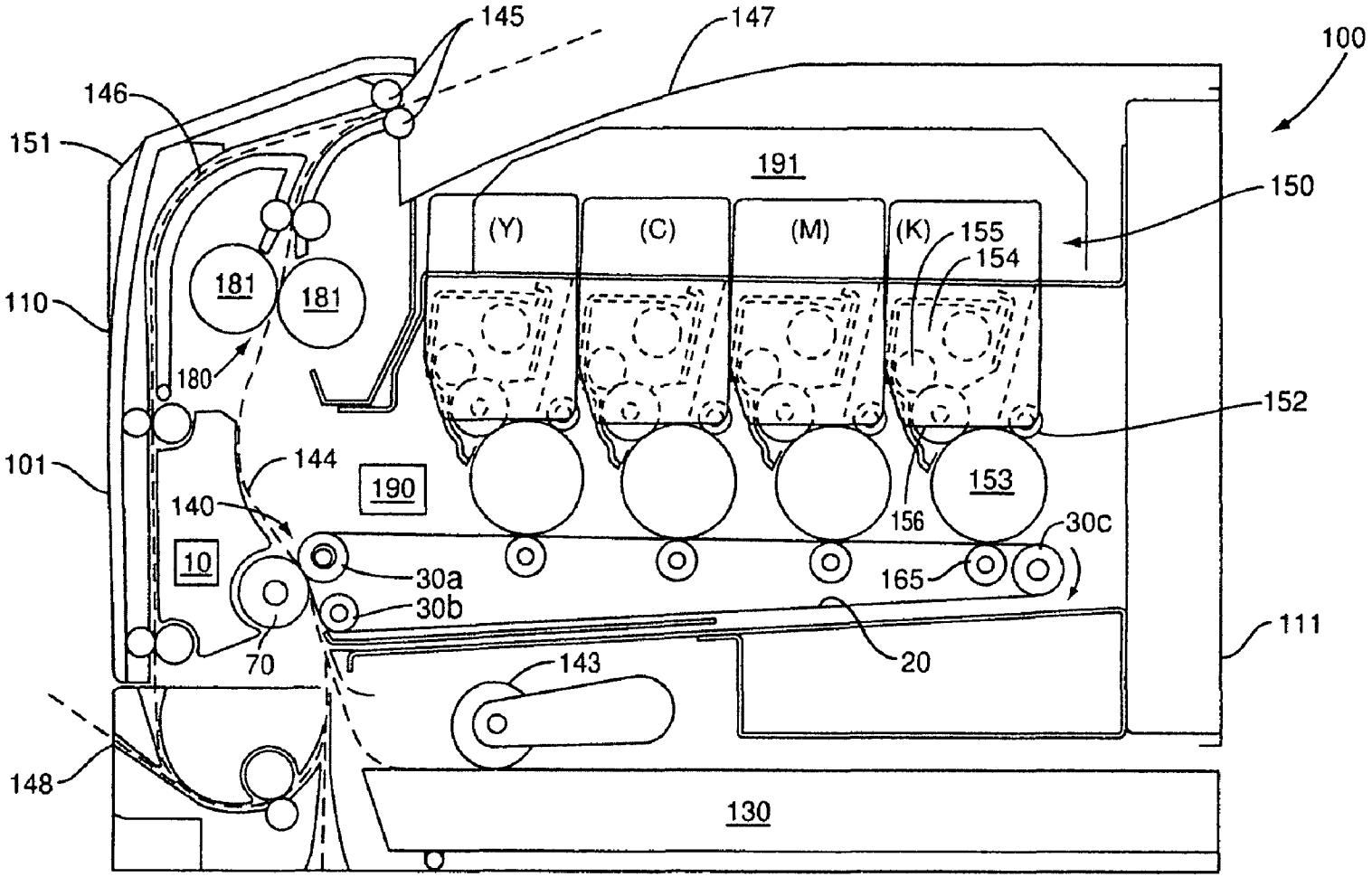
FIG. 2 is a schematic side view of an image forming device according to one embodiment.

A better understanding of the toner transfer system is available with an overall discussion of the image forming device 100. FIG. 2 is a schematic diagram of one embodiment of an image forming device 100 with a tensioning device 10. The device 100 includes a first toner transfer area with one or more imaging stations 150 that are aligned horizontally extending from the front 110 to the back 111 of the body 101. The imaging stations 150 are aligned along a transfer belt 20.

Each imaging station 150 includes a toner reservoir 154 to contain the toner. One or more agitating members may further be positioned within the reservoir 154 to move the toner. A toner adder roll 155 is positioned in the reservoir 154 to move the toner to a developer roll 156. The imaging stations 150 also include a photoconductive member 153 that receives toner from the developer roll 156. A charging member 152 is positioned to charge the photoconductive (PC) member 153. In one embodiment, each of the imaging stations 150 is substantially the same except for the color of toner. For purposes of clarity in FIG. 2, the elements are labeled on only the black K imaging station 150.

During image formation, the surface of the PC member 153 is charged to a specified voltage such as −1000 volts, for example. A laser beam from a printhead 191 is directed to the surface of the PC drum 153 and discharges those areas it contacts to form a latent image. In one embodiment, areas on the PC drum 153 illuminated by the laser beam are discharged to approximately −300 volts. The developer roll 156 then transfers toner to the PC drum 153 to form a toner image. The toner is attracted to the areas of the PC drum 153 surface discharged by the laser beam from the printhead 190.

The transfer belt 20 is disposed adjacent to each of the imaging stations 150. In this embodiment, the transfer belt 20 is formed as an endless belt trained about a plurality of support rolls. In this embodiment, the support rolls include a backup roll 30*a*, tension roll 30*b*, and a drive roll 30*c*. During image forming operations, the transfer belt 20 moves past the imaging stations 150 in a clockwise direction as viewed in FIG. 2. One or more of the PC drums 153 apply toner images in their respective colors to the transfer belt 20. For monocolor images, a toner image is applied from a single imaging station 150. For multi-color images, toner images are applied from two or more imaging stations 150. In one embodiment, a positive voltage field formed by transfer rolls 165 attracts the toner image from the PC drums 153 to the surface of the moving transfer belt 20.

The transfer belt 20 rotates and collects the one or more toner images from the one or more imaging stations 150 and then conveys the toner images to a media sheet at a second transfer area. The second transfer area includes a second transfer nip 140 formed between the back-up roll 30*a* and a second transfer roll 70.

A media path 144 extends through the device 100 for moving the media sheets through the imaging process. Media sheets are initially stored in an input tray 130 or introduced into the body 101 through a manual feed 148. The media sheet receives the toner image from the transfer belt 20 as it moves through the second transfer nip 140. The media sheets with toner images are then moved along the media path 144 and into a fuser area 180. Fuser area 180 includes fusing rolls or belts 181 that form a nip to adhere the toner image to the media sheet. The fused media sheets then pass through exit rolls 145 that are located downstream from the fuser area 180. Exit rolls 145 may be rotated in either forward or reverse directions. In a forward direction, the exit rolls 145 move the media sheet from the media path 144 to an output area 147. In a reverse direction, the exit rolls 145 move the media sheet into a duplex path 146 for image formation on a second side of the media sheet.

A controller 190 is included within the image forming device 100 to control the overall printing process including creation and timing of the toner images, and movement of the media sheets. Controller 190 may include a microprocessor with associated memory. In one embodiment, controller 190 includes a microprocessor, random access memory, read only memory, and an input/output interface. A control panel 151 may be operatively connected to the controller 190. The control panel 151 includes one or more input buttons and a display screen. The control panel 151 provides for a user to input commands as necessary.

Figure 3:
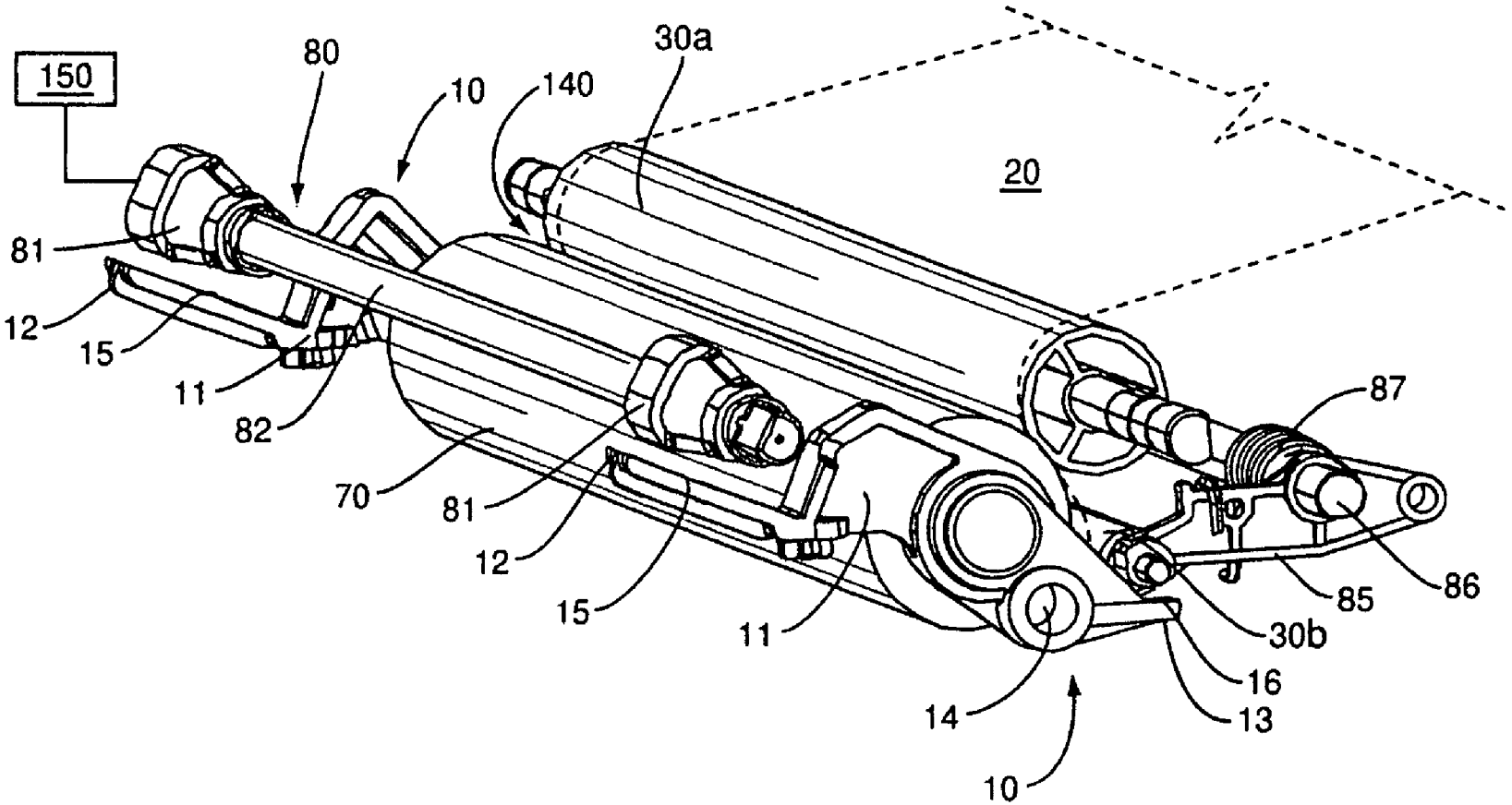
FIG. 3 is a perspective view of a pair of tensioning devices each with an arm in a first orientation and the transfer belt in a position for image formation according to one embodiment.

FIG. 3 illustrates a section of the transfer belt 20 wrapped around two support rolls 30. The support rolls are referred to in general with element 30 and specifically as the backup roll 30*a* and tension roll 30*b*. FIG. 3 illustrates the transfer belt 20 wrapped around the backup roll 30*a* and the tension roll 30*b*. The backup roll 30*a* forms the second transfer nip 140 with the second transfer roll 70 to transfer the toner images from the transfer belt 20 to the media sheets. The tension roll 30*b* is spaced away from the backup roll 30*a* and applies tension to the transfer belt 20.

The tension roll 30*b* is mounted on a member 85 that is connected to a pivoting shaft 86. A biasing member 87 extends between the body 101 and the member 85. The biasing member 87 applies a force to pivot the member 85 outward and away from the back up roll 30*a*. This biasing force causes the tension roll 30*b* positioned on the end of the member 85 to contact against an inner surface of the transfer belt 20 and maintain the desired tension on the transfer belt 20. The tension is adequate for the transfer belt 20 to be rotated by around the support rolls 30.

Figure 4:
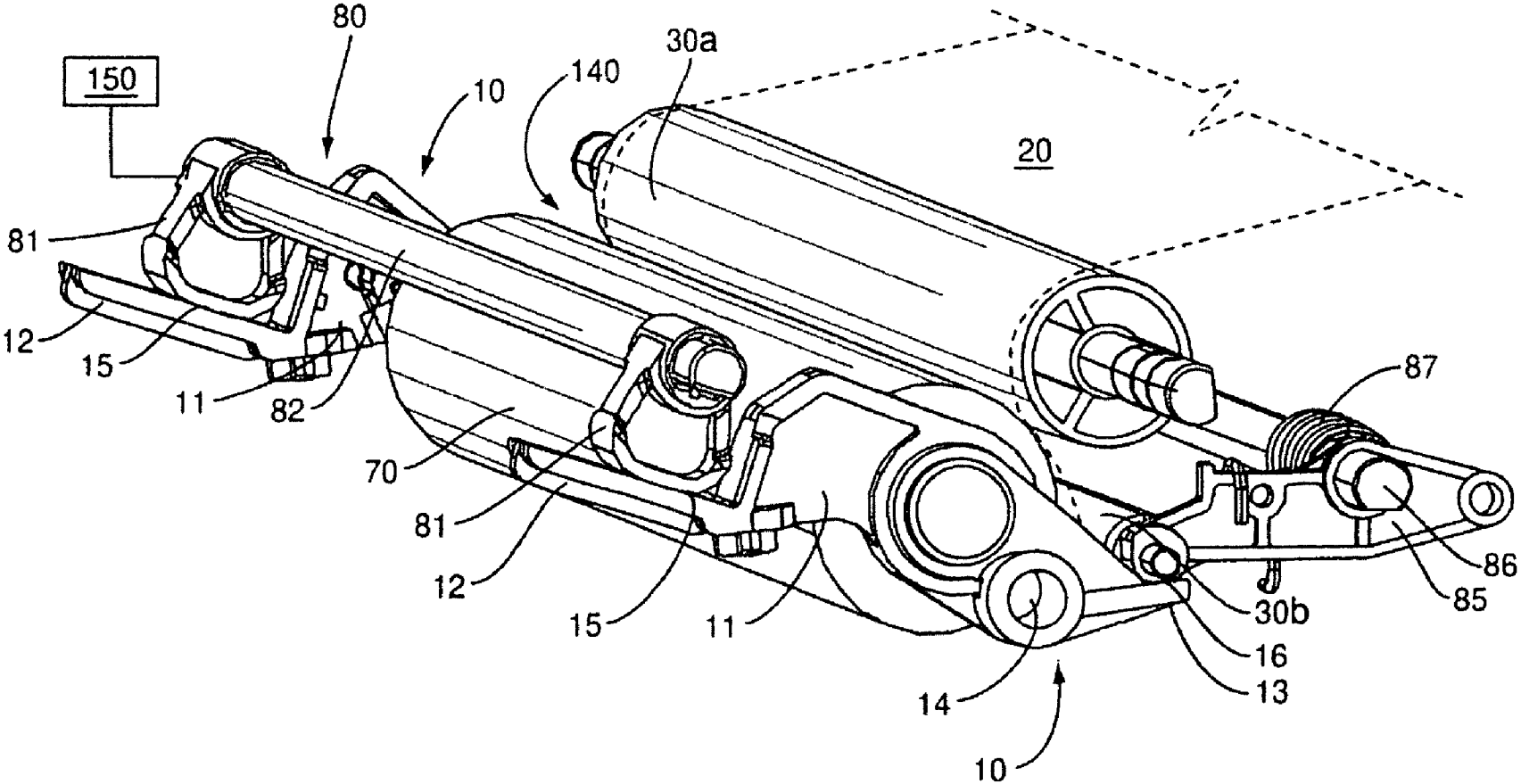
FIG. 4 is a perspective view of a pair of tensioning devices each with an arm in a second orientation and the transfer belt in a lessened tension state according to one embodiment.

The tensioning device 10 is positioned adjacent to the transfer belt 20 to adjust a position of one of the support rolls 30 thereby adjusting the tension on the transfer belt 20. In the embodiment of FIGS. 3 and 4, the tensioning device 10 adjusts the position of the tension roll 30*b*.

The tensioning device 10 includes an arm 11 with a first end 12 and a second end 13 each including contact surfaces 15, 16, respectively. The arm 11 is pivotally positioned about an intermediate pivot 14. In one embodiment, the second end 13 is closer to the pivot 14 than the first end 12. The arm 11 is further connected to the second transfer roll 70. In the embodiment of FIG. 3, the second transfer roll 70 is connected to the arm 11 on an opposite side of the pivot 14 from the second end 13. FIG. 3 illustrates the arm 11 in a first orientation that does not affect the tension on the transfer belt 20. The arm 11 is in the first orientation during image formation.

The tensioning device 10 further includes a contact mechanism 80 that moves the arm 11 from the first orientation to a second orientation. In one embodiment as illustrated in FIG. 3, the contact mechanism 80 includes a cam 81 positioned on a shaft 82. The contact mechanism 80 is movable between a first position and a second position. In the first position as illustrated in FIG. 3, the cam 81 spaced away from the contact surface 15 on the arm 11. This positioning of the cam 81 orients the arm 11 in the first orientation with the contact surface 16 towards the second end 13 of the arm 11 positioned away from the tension roll 30*b*.

Contact mechanism 80 is further movable to a second position as illustrated in FIG. 4. The shaft 82 is rotated causing the cam 81 to contact against the contact surface 15 of the arm 11. The cam 81 includes a curved surface along first and second sections and is positioned such that the contact causes the arm 11 to move about the pivot 14 to the second orientation. The pivoting movement of the arm 11 causes the contact surface 16 to contact the tension roll 30*b*. The force applied to the arm 11 through the contact mechanism 80 overcomes the force applied on the tension roll 30*b* by the biasing member 87. This causes the tension roll 30*b* to move inward towards the backup roll 30*a*. This inward positioning causes a decrease in the amount of tension on the transfer roll 20. The lesser tension prevents the transfer belt 20 from forming a set. In one embodiment, the contact surface 16 contacts the tension roll 30*b*. In another embodiment, the contact surface 16 contacts the member 85 to move the tension roll 30*b*.

Movement of the arm 11 to the second orientation also moves the second transfer roll 70. In one embodiment, the second transfer roll 70 moves away from the backup roll 30*a*. This spacing may be beneficial to remove media sheets from the second transfer nip 140 in the event of a jam.

Figure 5:
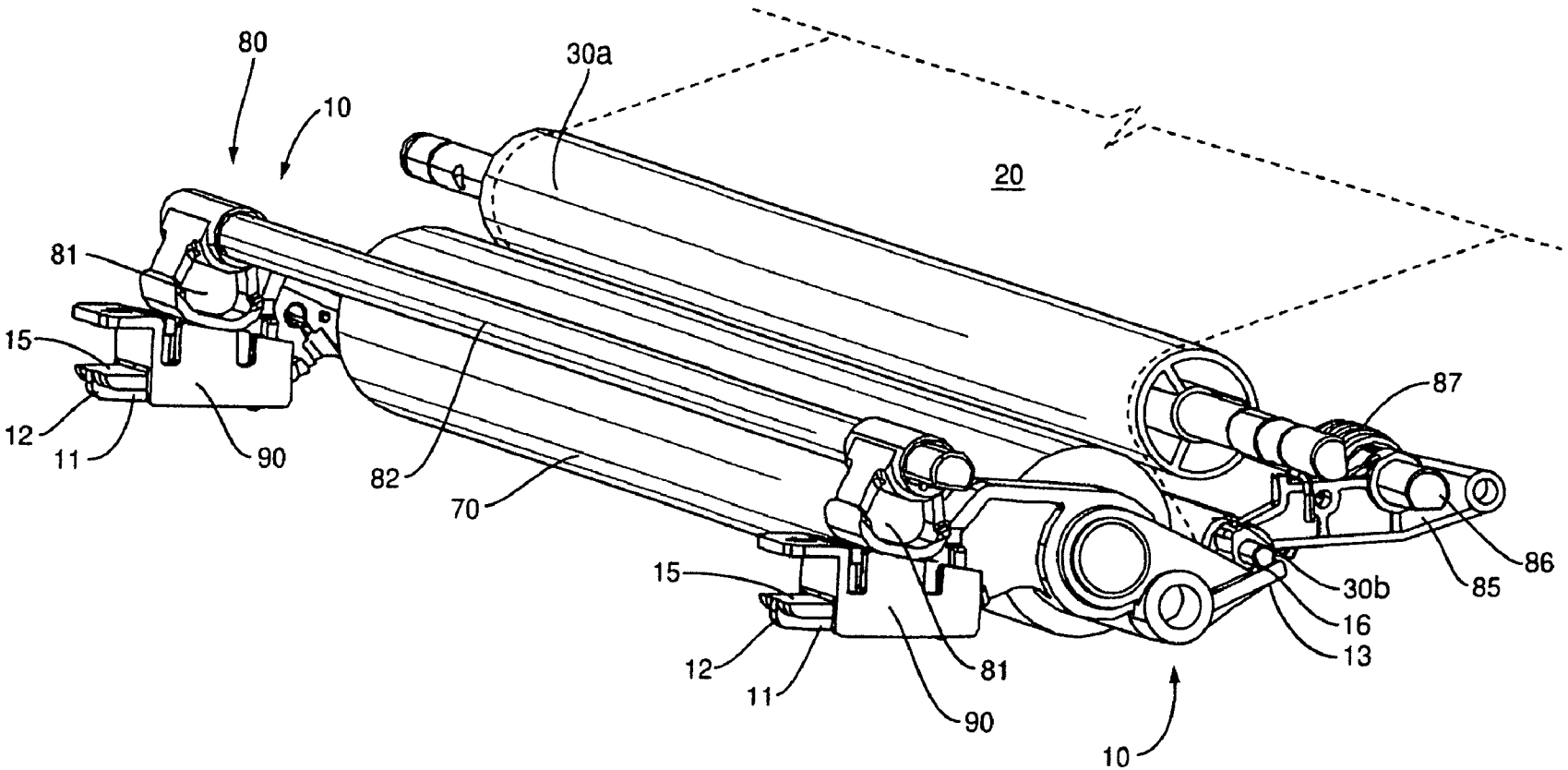
FIG. 5 is a perspective view of a pair of tensioning devices with packaging materials according to one embodiment.

In the embodiments of FIGS. 3 and 4, the contact mechanism 80 is positioned for the cam 81 to directly contact against the contact surface 15 on the arm 11. FIG. 5 includes an embodiment with a packaging member 90 positioned between the cam 81 and the arm 11. The packaging member 90 acts as a spacer to allow the contact mechanism 80 to position the arm 11 in the second orientation and remove tension from the transfer belt 20. In one embodiment, the packaging member 90 is originally placed into the image forming device 100 during initial assembly. Prior to use, the user removes the packaging material which allows the contact mechanism 80 to adjust the position of the arm 11 as previously explained.

The embodiments of FIGS. 3, 4 and 5 include a pair of tensioning devices 10. A first tensioning device 10 is positioned on a first side of the second transfer roll 70 and tension roll 30*b*, and a second tensioning device 10 is positioned on a second side of the second transfer roll 70 and tension roll 30*b*. Further, the contact mechanism 80 includes a pair of cams 81 with a first cam 81 directly or indirectly contacting the first tensioning device 10 and a second cam 81 contacting the second tensioning device 10. In another embodiment, a single tensioning device 10 is used for adjusting the tension on the transfer belt 20.

In one embodiment, the tensioning device 10 is used throughout the life of the image forming device 100. The user is able to adjust the tension by entering commands to the controller 190 through the input panel 151. This enables the user to control the tension on the transfer belt 20 as necessary.

In another embodiment, the contact mechanism 80 operates a single time to adjust the tension on the transfer belt 20. In one embodiment, the tensioning device 10 is initially set with the arm 11 in the second orientation to lessen the tension. This may occur during assembly of the image forming device 100. Prior to operating the image forming device 100, the tensioning device 10 is activated to move the arm 11 to the second orientation to allow image formation. The activation of the tensioning device 10 may occur automatically through the controller 190 when the image forming device 100 is initially activated by the user prior to first use. Alternatively, the user may be prompted to enter commands through the input panel 151 to activate the tensioning device 10.

In the embodiments of FIGS. 3, 4, and 5, the tensioning device 10 includes a contact mechanism 80 to adjust the orientation of the arm 11. In another embodiment, a lever is operatively connected to the arm 11. The lever may be physically moved by the user to adjust the orientation of the arm 11.

The embodiments described above include the tensioning device 10 operatively connected to the tension roll 30*b*. In other embodiments, the tensioning device 10 is operatively connected to either the backup roll 30*a* or the drive roll 30*c*.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A toner transfer system in an image forming device comprising:

a transfer belt that extends around at least a first roll and a second roll;

a second transfer roll positioned on an opposite side of the transfer belt from the first roll, the second transfer roll and the first roll forming a second transfer point to move a toner image from the transfer belt to a media sheet;

an arm operatively connected to the second transfer roll and movable between a first orientation causing the second roll to be positioned to give the transfer belt a first amount of tension and a second orientation causing the second roll to be positioned to give the transfer belt a second amount of tension that is less than the first amount; and a contact mechanism movable between a first position spaced away from the arm and causing the arm to be in the first orientation and a second position in contact with the arm causing the arm to be in the second orientation;

wherein the arm includes an elongated shape with a first end and a second end, the second end being in contact with the second roll when the arm is in the second orientation.

2. The toner transfer system of claim 1, wherein the arm includes a pivot positioned between the second end and a connection with the second transfer roll.

3. The toner transfer system of claim 2, wherein the first end includes a contact surface positioned a greater distance from the pivot than the second end.

4. The toner transfer system of claim 1, wherein the first end of the arm is contacted by the contact mechanism.

5. The toner transfer system of claim 1, wherein the second roll is positioned on a member.

6. The toner transfer system of claim 1, further comprising a biasing mechanism that biases the second roll outward to be positioned to give the transfer belt the first amount of tension.

7. The toner transfer system of claim 1, wherein the contact mechanism includes a pivoting shaft with a cam mechanism that contacts against the arm.

8. The toner transfer system of claim 4, wherein a distance between a rotational axis of the second transfer roll and the first end of the arm is less than a distance between a pivot axis of the arm and the first end thereof.

9. The toner transfer system of claim 4, wherein a distance between a rotational axis of the second transfer roll and the second end of the arm is greater than a distance between a pivot axis of the arm and the second end thereof.

10. The toner transfer system of claim 5, wherein the second roll pivots about an axis responsive to contact with the arm.

11. The toner transfer system of claim 1, further comprising a packaging member positioned on the first end of the arm for positioning the arm in the second orientation.

12. The toner transfer system of claim 1, wherein the second transfer roll is positioned on an outer side of the transfer belt with the movement of the arm from the first orientation to the second orientation causing movement of the second transfer roll in a direction where it separates from the first roll.

13. The toner transfer system of claim 1, wherein the movement of the arm from the first orientation to the second orientation causes movement of the second roll in a direction towards the first roll.

14. The toner transfer system of claim 7, wherein the cam mechanism contacts the first end of the arm to move the arm from the first orientation to the second orientation.

15. A method of operating a toner transfer system in an image forming device comprising:

positioning an arm in a first orientation and causing a first amount of tension on a transfer belt that extends around a plurality of support rolls;

positioning a second transfer roll at a first location relative to a first of the plurality of support rolls when the arm is in the first orientation;

moving a contact mechanism into contact with a packaging member positioned on a first end of the arm;

pivoting the arm from the first orientation to a second orientation and causing a second end of the arm to move a second of the plurality of support rolls causing a second lesser amount of tension on the transfer belt; and moving the second transfer roll to a different second location relative to the first of the plurality of support rolls when the arm pivots from the first orientation to the second orientation.

16. The method of claim 15, further comprising contacting the contact mechanism against a member that is spaced away from the arm and moving the arm from the first orientation to the second orientation.

17. The method of claim 15, further comprising biasing the first of the plurality of support rolls in a direction to maintain the first amount of tension on the transfer belt.

18. The method of claim 15, further comprising moving the contact mechanism away from the arm and returning the arm to the first orientation and causing the first amount of tension to again be placed on the transfer belt.

19. The method of claim 15, further comprising pivoting a member that is operatively connected to the second of the plurality of rolls when the arm moves from the first orientation to the second orientation.

20. A toner transfer system in an image forming device comprising:

a transfer belt that extends around at least a first roll and a second roll;

a second transfer roll positioned on an opposite side of the transfer belt from the first roll, the second transfer roll and the first roll forming a second transfer point to move a toner image from the transfer belt to a media sheet;

an arm operatively connected to the second transfer roll and movable between a first orientation causing the second roll to be positioned to give the transfer belt a first amount of tension and a second orientation causing the second roll to be positioned to give the transfer belt a second amount of tension that is less than the first amount; and a contact mechanism movable between a first position spaced away from the arm and causing the arm to be in the first orientation and a second position in contact with the arm causing the arm to be in the second orientation;

wherein the arm includes a first end that is contacted by the contact mechanism and a second end that contacts the second roll.

* * * * *